US006910238B2

(12) United States Patent
Biggie et al.

(10) Patent No.: US 6,910,238 B2
(45) Date of Patent: Jun. 28, 2005

(54) APPARATUS AND METHOD FOR EXACT CONTROL OF CROSS OVER PRESSURES, INCLUDING HIGH AND LOW PRESSURES, BY DYNAMICALLY VARYING THE COMPRESSOR PUMP OUTPUT IN ALTERNATING PRESSURE SUPPORT SURFACES

(76) Inventors: Lydia Biggie, 3041 NE. 48th St., Lighthouse Point, FL (US) 33064; John Biggie, 3041 NE. 48th St., Lighthouse Point, FL (US) 33064; David Genaro, 1818 Adventure Pl., N. Lauderdale, FL (US) 33068

( * ) Notice: Subject to any disclaimer, the term of this patent is extended or adjusted under 35 U.S.C. 154(b) by 0 days.

(21) Appl. No.: 10/604,068

(22) Filed: Jun. 25, 2003

(65) Prior Publication Data

US 2004/0261182 A1 Dec. 30, 2004

(51) Int. Cl.[7] ..... A47C 27/10
(52) U.S. Cl. ..... 5/713; 5/710
(58) Field of Search ..... 5/706, 710, 713–714, 5/655.3, 654

(56) References Cited

U.S. PATENT DOCUMENTS 6,698,046 B1 * 3/2004 Wu ..... 5/713

* cited by examiner

*Primary Examiner*—Heather Shackelford
*Assistant Examiner*—Fredrick Conley
(74) *Attorney, Agent, or Firm*—John C. Smith

(57) ABSTRACT

An alternating pressure support surface for use by patients requiring bed rest. The air pressure control system used by the alternating pressure surface dynamically controls air pressure in multiple inflatable compartments and further controls the cross over pressure as sets of inflatable compartments are simultaneously being inflated and deflated. A pressure transducer provides feedback which is used to dynamically adjust the output pressure produced by a pump to prevent over inflation or under inflation and ensure that cross over air pressure is properly maintained to prevent under inflation which results in bottoming out.

20 Claims, 8 Drawing Sheets

APPARATUS AND METHOD FOR EXACT CONTROL OF CROSS OVER PRESSURES, INCLUDING HIGH AND LOW PRESSURES, BY DYNAMICALLY VARYING THE COMPRESSOR PUMP OUTPUT IN ALTERNATING PRESSURE SUPPORT SURFACES

BACKGROUND OF INVENTION

1. Technical Field

The present invention relates to alternating pressure support surfaces. In particular, it relates to alternating pressure specialty mattresses that provide pressure to only a portion of a body's surface at a time by dynamically varying pressure in discrete compartmented cells of the mattress.

2. Background Art

There are innumerable illnesses and injuries that result in the need for extended bed rest by patients and invalids. Unfortunately, while bed rest is often used to facilitate a patient's recovery from illnesses or injuries, an excessive amount of time spent in bed rest often creates other medical problems. In particular, extended bed rest can result in pressure wounds such as decubitus ulcers or bed sores. The pressure wounds are caused by the reduction in blood flow at a particular point on the patient's body. Usually, this is due to excessive pressure at that point which is caused by continuous uneven support provided by the mattress or support surface which the patient is laying on. As the blood flow is cut off, sores can quickly develop and extend at a rapid pace. If not promptly and properly treated, pressure wounds can even result in a greater injury to a patient than the original illness or injury for which the bed rest was taken. As a result, it would be desirable to have a method of eliminating, or reducing the possibility of getting, pressure wounds when a patient is confined to bed rest.

An early attempt to address this problem was initiated by medical practitioners who would attempt to prevent the occurrence of pressure wounds by physically rotating a patient on the patient's bed on a periodic basis. Due to the shortage of personnel at many medical facilities, or to oversight, manual rotation of patients may not always occur at the proper time. Sometimes, it may not occur at all. As a result, even in a facility where the staff is trained and aware of the problems associated with pressure wounds, patients may not receive adequate care in regard to the avoidance of pressure wounds. It would be desirable to have a method of avoiding the need to rely on human action and to automatically avoid pressure wound injuries caused by constant pressure applied to particular areas of a patient's body.

Another attempt to avoid pressure wounds has been the development of a particular type of specialty mattress that is commonly known as a support surface. This type of mattress attempts to avoid pressure wounds by reducing pressure on the mattress surface through the use of air, gel, or foam. The air, gel or foam based support surfaces are designed to avoid pressure wounds by distributing the patient's weight across a large surface area, which in turn reduces the pressure per square inch and subsequently provides less restriction on patient blood flow. While providing superior performance over conventional mattresses, the specialty mattresses cannot provide a complete answer to the problem of restricted blood flow due to the constant pressure applied against the surface of a patient's body.

An attempt to address this problem has resulted in the development of alternating pressure support surfaces. Support surfaces, which utilize alternating pressure, are used to prevent and cure pressure wounds such as decubitus ulcers and bed sores. In theory, when a patient is placed on this specialty mattress, only one half of the patient's body has pressure on it at any given time. This is accomplished by inflating one set of cells while a second set of cells is deflated. The inflated cells support the weight of the body while the deflated cells do not provide pressure on the patient's body. As a result, the deflated cells provide pressure relief and thereby encourage blood flow. Alternating pressure support surfaces typically use a preset time interval to alternate pressure within the cells. This time interval is typically around five minutes. At the end of the preset time interval, the inflated cells will deflate as the deflated cells inflate. This continually changes the pressure points on the body, allowing blood to flow more freely. The improved blood flow helps to prevent pressure wounds from occurring, and also helps pre-existing wounds to be healed.

While alternating pressure support surfaces improved over the prior art, they have serious drawbacks in that they often are not able to consistently reduce pressure to the proper level and control pressure at the proper levels for the purposes of encouraging blood flow and avoiding pressure wounds. In particular, unless the deflating air cells reach zero or almost zero pressure (2–3 mmHg) inside the air cell, there can still be too much pressure on the patient's body. In fact, the amount of residual pressure can still be enough to break down the patient's skin. Further, even when the air pressure inside the air cell is at zero, there is still pressure on patient's skin that is known as interface pressure. Interface pressure results from the added pressure from coverlets, sheets, bed clothing, etc. It is typically in the range of 3–10 mmHg greater than the pressure inside the air cell. As a result, these prior art systems often fail to prevent pressure wounds because the combination of inaccurate air pressure and interface pressure results in a residual pressure against the skin which is significant enough to inhibit blood flow. It would be desirable to have a system capable of accurately maintaining the desired air pressures inside the air cell such that areas on the surface of a patient periodically have very low interface pressure (zero pressure in the air cell), and a system which is also capable of measuring air cell pressures and adjusting air pressures to account for them.

Another problem associated with prior art alternating pressure support surfaces is that they do not properly control cross over pressures. Cross over pressure is the pressure at which the pressure inside the deflating air cells equals the pressure inside the inflating air cells. Improperly controlled cross over pressure can also contribute to pressure wounds. In particular, if the cross over pressure is too high, then the air cells are over inflated to the point where pressure is applied to the entire surface of the patient's body which means that the patient's body does not receive the benefit of the reduced pressure which would have resulted in increased blood flow. Likewise, if the cross over pressure is too low, then a condition known as bottoming out occurs. Bottoming out is a condition where insufficient air pressure under the patient allows the patient's body to come in contact with the bed frame, resulting in constant pressure against the patient's body. This has the same effect as cross over pressure which is too high. Namely, pressure is applied by the support substrate to the entire surface of the patient which acts to restrict blood flow. It would be desirable to have a system capable of maintaining the cross over pressure point such that it is not too high or too low, thereby preventing pressure from being applied to the patient's entire body surface.

While attempting to address the basic need to prevent the formation of pressure wounds during the healing process, the prior art has failed to provide an alternating pressure support surface that is capable of dynamically measuring and controlling pump pressure, which is capable of dynamically measuring and adjusting pressure to account for air cell pressure, and dynamically measuring and controlling cross over pressure to prevent both over inflation and bottoming out.

SUMMARY OF INVENTION

The present invention solves the foregoing problems by providing an air pressure control system in which the output pressure produced by a pump is dynamically adjusted to prevent over inflation, to prevent under inflation which results in bottoming out, and to control cross over pressure to ensure that cell pressure in the deflated state is sufficiently low or zero to prevent excessive pressure from being applied to a patient's body surface.

DETAILED DESCRIPTION

Figure 1:
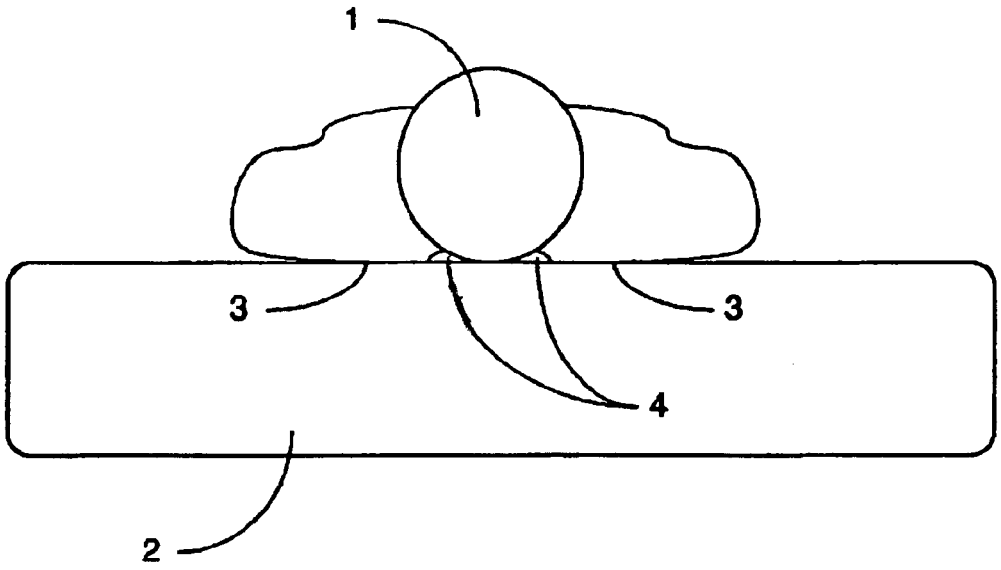
Figure 1 Prior Art
FIG. 1 is an end view of a conventional prior art mattress which is illustrated with a patient lying on its surface.

Prior to a detailed discussion of the figures, a general overview of the alternating pressure support surface provided herein will be presented. The alternating pressure support surface is designed to be used by patients requiring long-term bed rest. It typically includes multiple inflatable cells in which at least two separate sets are alternately inflated and deflated such that one set provides support for a patient while the other set is deflated to allow blood flow in the surface of the patient which is not touching that set of inflatable cells.

The actual success of alternating pressure surfaces depends on two important criteria. The first criterion is the ability to control the amount of air going into or venting from an air cell such that the air pressure can be very accurately determined and that the desired air pressure can be maintained. The second criterion is to very accurately determine the cross over pressures between high-pressure and low pressure cells as they go through their cycles.

Regarding the first criterion (namely, controlling the pressurizing and venting of the alternating pressure support surfaces), unless the air cells that are deflating reach zero or almost zero pressure (2–3 mmHg) inside the air cell, the remaining pressure inside the cell may still be enough to obstruct blood flow and contribute to tissue breakdown that results in pressure wounds. Further, since the interface pressure typically remains higher than the internal cell pressure by 3–10, mmHg, even though prior art devices may lower the cell pressure, the total pressure exerted against the surface area of the patient may remain high enough to foster the creation of pressure wounds.

In order to properly control internal cell pressure, it is important to be able to accurately measure pressure in the inflated state, in the deflated state, and while changing from one state to another. The invention accomplishes this by dynamically combining two control methods.

The first method is to control the output of the compressor pump beyond merely turning it either completely on or completely off. This system does not use a simple on/off approach because when turning the pump on at full flow, often too much air fills the air cells. As a result, the air cells would then have to be vented to reduce the pressure. In turn, the venting may result in an under pressure condition. This cycle of over filling and then venting can significantly increase the time for the system to stabilize and have accurate high pressures. The invention avoids this by dynamically varying the compressor pump speed such that the pump will automatically slow down as it approaches the appropriate pressure levels. This is accomplished by using a voltage controlled dimmer feedback circuit (an AC phase control) to drive the pump. The dimmer is connected to a linear pressure sensor which is connected to the pump output to form a servo-loop. The pressure is set by applying a DC voltage which is compared to the output of the linear pressure sensor that in turn drives the voltage controlled dimmer which regulates the pump output.

The second method includes the use of pressure sensors which are connected directly to the air lines that are connected to the air cells. The output from the pressure sensors (which measures the internal cell pressure) is used to provide information to the circuit that not only controls the output of the pump, but also controls the venting process. Solenoid valves are used by the venting process to. control venting of air cells to reduce pressure, or to block air entering the cells. The pressure sensors also provide information to display panels which constantly display the pressures in the cells. Displaying these pressure values informs the user of conditions in the alternating pressure surfaces and indicates any changes that may be necessary.

An important display value, used by the invention, is the display of the cross over pressure in the cells sets. Visual display of the cross over pressure, in combination with manual control of the pump pressure output via DC control voltage 24 (shown below in regard to FIG. 5), allows the care provider to adjust the cell cross over pressure to a sufficient level that bottoming out is avoided.

The second criterion relates to the measurement and control of the cross over pressure. The cross over pressure is the point where the pressure in the deflating cells is equal to the pressure in the inflating cells of the alternating pressure surface which occurs when the cells are in a transition state between inflated and deflated states. When the cells are in the transition state, it is desirable to carefully control transition state pressure. The transition state occurs when some cells are venting or deflating, while at the same time the other cells are inflating. During this transition state, no portion of the patient's body receives zero pressure (e.g. no cells are at or close to zero pressure). However, it is also important that there is enough pressure in all cells to prevent the patient's body from bottoming out. As noted above, bottoming out is a condition where insufficient air pressure under the patient allows the patient's body to come in contact with the bed frame or support substrate. As a result, proper cross over pressure results in a good transition state wherein the internal cell pressure is neither too high nor too low.

Proper cross over pressure is important because, if the cross over pressure is too high, it means that the deflated air cells had excess air in them before the inflated air cells were allowed to vent. When this condition occurs, the entire body is subject to an undesirably high air pressure which increases the time that the whole body of the patient is subject to high pressure. Likewise, if the cross over pressure is too low, it may result in the patient bottoming out and again receiving pressure against the patient's entire body that is too high.

Unfortunately, cross over pressure was not a parameter that could be controlled directly by the prior art. Instead, the prior art relied strictly on system timing, and did not take into account such variables as patient body type and pump volume (which decreases as the pump ages and minor system leaks develop). Neglecting these variables requires setting the timing for a worst case scenario, which results in a higher than desirable cross over pressure for the average patient. The invention accounts for these variables, and maintains cross over pressure at accurate levels, by monitoring cell air pressures and using the monitored air pressure values to control timing and control cell pressures as described more fully below.

The invention controls the cross over pressure such that it is neither too high nor too low. As a result, it avoids the situation where an over inflated alternating pressure surface is applying too much pressure to the surface of a patient's body, and simultaneously avoids the situation where an under inflated alternating pressure support surface applies insufficient pressure to the surface of the patient's body which results in the patient bottoming out.

Control of the cross over pressure is accomplished by dynamically controlling the pressure pump output through the use of pressure sensors which detect pump output pressure and provide feedback to control the servo-loop which controls the pump.

The foregoing discussion provided a general overview of how the invention controls inflated and deflated pressure, and the cross over pressure which occurs during transition between inflated and deflated states. Prior to a discussion of the pressure control system, a general description of the alternating pressure support surface will now be presented. The pressure support surface generally resembles a mattress and is sized accordingly. As is the case with conventional mattresses, alternating pressure support surfaces can vary in size to accommodate patients of differing sizes. Likewise, the pressure support surfaces can vary in thickness. For example, they typically vary between four and fourteen inches in thickness. As a result, both size and thickness is not critical and may vary to suit the physical characteristics of a particular patient.

Alternating pressure support surfaces typically are segmented into a number of inflatable cells which are independently inflatable or deflatable such that pressure in a particular part of the pressure support surface can be varied. In theory, when a patient is placed on an alternating pressure support surface, only one half of their body has pressure on it at any given time. As a result, it is not important how the cells are arranged so long as they achieve the goal of periodically eliminating surface pressure on selected areas of a patient's body. The size, location, number and placement of the cells is not critical and may vary to suit a particular design. As a result, any suitable arrangement of cells that will accomplish the pressure reduction goals of the invention can be used. However, while cells can be arranged in any convenient configuration, it may be more efficient for manufacturing purposes to provide cells which are arranged longitudinally or laterally in the pressure support surface.

In the preferred embodiment, a series of cells is arranged such that adjacent cells are in opposing states (inflated or deflated). This is achieved by only inflating every other cell while the remaining air cells are deflated to allow pressure relief. The cells are then alternately deflated and inflated to vary the location on the patient's body where pressure is applied. Preferably, the inflation/deflation process operates on five minute intervals. However, those skilled in the art will recognize that this time period is not critical and may vary. The time period selected need only be sufficient such that by continuously changing pressure points on the body, blood is allowed to flow throughout the body, and pressure wounds are prevented or healed.

As discussed above, alternating pressure support surfaces provided by the prior art often fail because the cross over pressure points are either too high or too low. If the cross over pressure points are too high, typically the pressure provided by the alternating pressure support surfaces results in constant pressure against some or all parts of the patient's body. This increased pressure may result in restricted blood flow and actually foster the creation of pressure wounds. Likewise, if the cross over pressure point is too low, another problem known as "bottoming out" occurs. When this happens, the internal air pressure in the inflatable cells is so low that the patient's body presses against the support substrate, which results in the same problems associated with over inflation. Namely, blood flow restriction and the creation of pressure wounds. As can be seen, the dynamic and accurate control of cross over pressure can eliminate these problems.

The alternating pressure support system provided by this invention is designed to overcome the limitations of the prior art alternating pressure support surfaces by dynamically regulating air pressure and cross over pressure in the inflatable cells. By maintaining cross over air pressure at proper levels, the invention prevents over inflation which causes constant pressure against the surface of a patient's body. Likewise, the invention also eliminates low cross over pressure in the inflatable cells which may result in patient bottoming out that will also cause undesirable pressure on the patient's body.

The invention provides an alternating pressure support surface which uses a circuit to measure and control air pumps such that their output pressures are dynamically controlled to maintain cross over air pressures at acceptable levels. While each cell can have its own air pressure pump and associated control circuitry, the goals of the invention can be accomplished by a single pump and associated circuitry. Having described the invention in general, we turn now to a more detailed discussion of the figures.

FIG. 1 is an end view of a conventional prior art mattress 2. In this figure, a patient 1 is shown lying on the mattress 2. As can be seen, there are gaps 4 between the mattress 2 and the body surface of the patient 1. Likewise, there are pressure points 3 where the patient's body is in contact the mattress 2. Since a conventional mattress does not provide any method of changing the pressure points 3 on the patient's 1 body, the constant pressure of the mattress 2 on the pressure points 3 will constantly restrict blood flow at the pressure points 3. As a result, this constant pressure may result in the formation of pressure wounds at those pressure points 3.

As discussed above, the only way to avoid pressure wounds for a patient 1 using a conventional mattress 2 would be to manually rotate the patient's 1 position on a scheduled basis. Of course this often requires that skilled personnel, such as nurses, be made available to help in this process. This increases the cost of medical care and diverts the nurse's attention from other patients. In addition, there is also the danger that due to workloads and other factors, the personnel required to rotate the patient's 1 position may inadvertently neglect to do so. When this happens, the patient 1 may develop pressure wounds.

Figure 2:
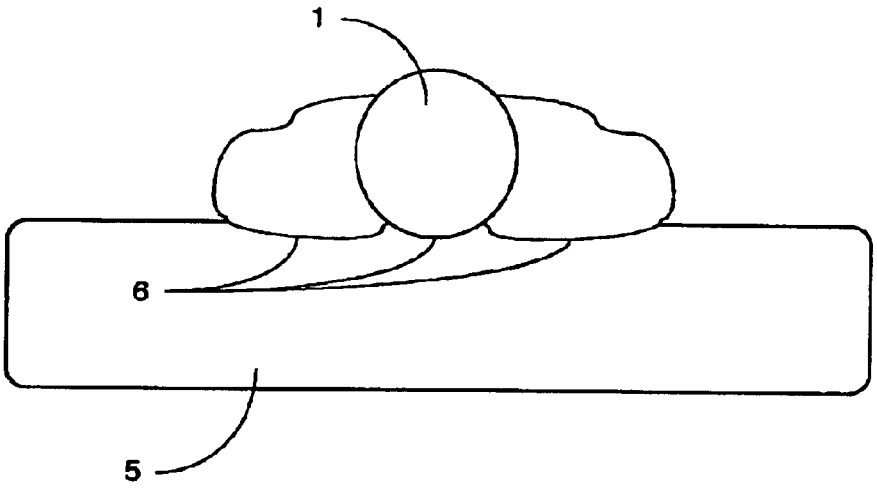
Figure 2 Prior Art
FIG. 2 is an end view of a prior art support surface mattress which is illustrated with a patient lying on its surface.

FIG. 2 illustrates an end view of a prior art support surface mattress 5. The support surface mattress 5 is generally fabricated such that when the patient 1 lays on the support surface mattress 5, the patient's 1 body sinks into the support surface mattress 5 such that the entire surface 6 of the patient's body 1 is in contact with the support surface mattress 5. As a result, by spreading the pressure which is created when the patient 1 lays on the support surface mattress 5 across the entire surface area of the patient 1, the average pressure per square inch is reduced. While this can help to avoid pressure wounds, it also results in a situation where pressure is constantly applied to the surface of the patient's 1 body. As a result, support surface mattresses 5 can also create pressure wounds because each area on the patient's 1 body is never totally free of pressure.

Figure 3A:
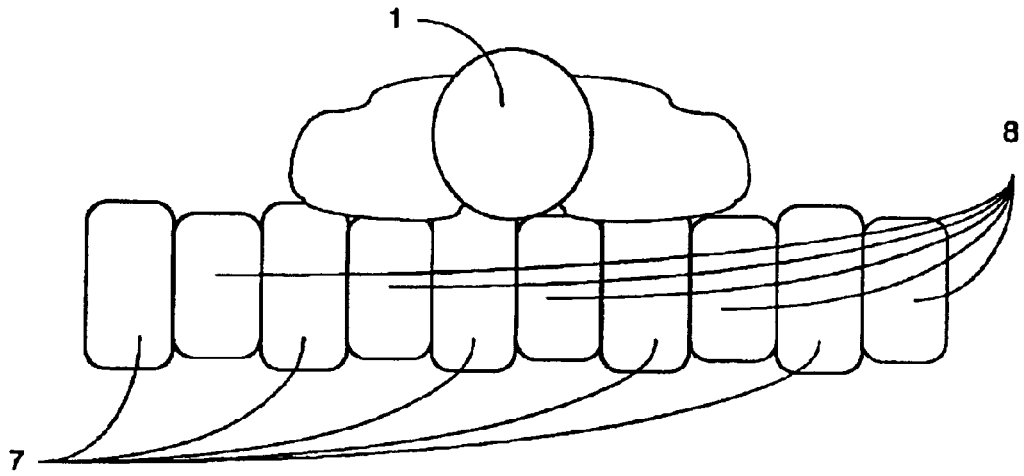
Figure 3A Prior Art
FIG. 3A is an end view of a prior art alternating pressure support surface which is illustrated with a patient lying on its surface. This figure illustrates the position of the patient when the cross over pressure is too high.

In FIG. 3A, an end view of a prior art alternating pressure support surface having a first series of cells 7, and a second series of cells 8. As shown this figure, the first series of cells 7 are inflated and provide pressure support for the patient's 1 body. Likewise, the second series of cells 8 are deflated and provide reduced pressure for the patient's 1 body. As a result, the body surface areas above the second series of cells 8 are intended to have reduced pressure and increased blood flow. For ease of illustration, ten cells were used to illustrate FIG. 3A. However, those skilled in the art will recognize that any suitable number of cells can be used to accomplish the purpose of the invention.

This figure also illustrates the situation where the cross over pressure is too high. As can be seen, when the cross over pressure is too high, even though the second set of cells 8 has a lower pressure in the first set of cells 7, both the first and second sets of cells 7, 8 have sufficient internal pressure such that pressure is applied to the entire surface of the patient's 1 body. This results in the situation where pressure wounds may be created because the surface of the patient's 1 body constantly has pressure applied to it.

Figure 3B:
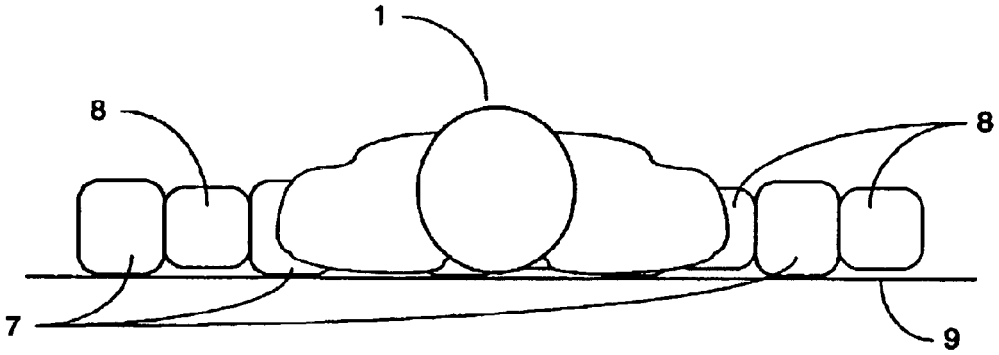
Figure 3B Prior Art
FIG. 3B is an end view of a prior art alternating pressure support surface which is illustrated with a patient lying on its surface. This figure illustrates the position of the patient when the cross over pressure is low and bottoming out occurs.

In FIG. 3B, an end view of the prior art alternating pressure support surface illustrated in FIG. 3A is also shown. This figure illustrates the situation where the cross over pressure in the first and second series of cells 7, 8 are too low. As can be seen, the low pressures result in the patient's 1 body coming in close proximity with the support substrate 9 (which may be a bed frame or any other support surface). This will also result in constant pressure applied to areas of the patient's 1 body with the subsequent risk of pressure wounds.

Figure 4A:
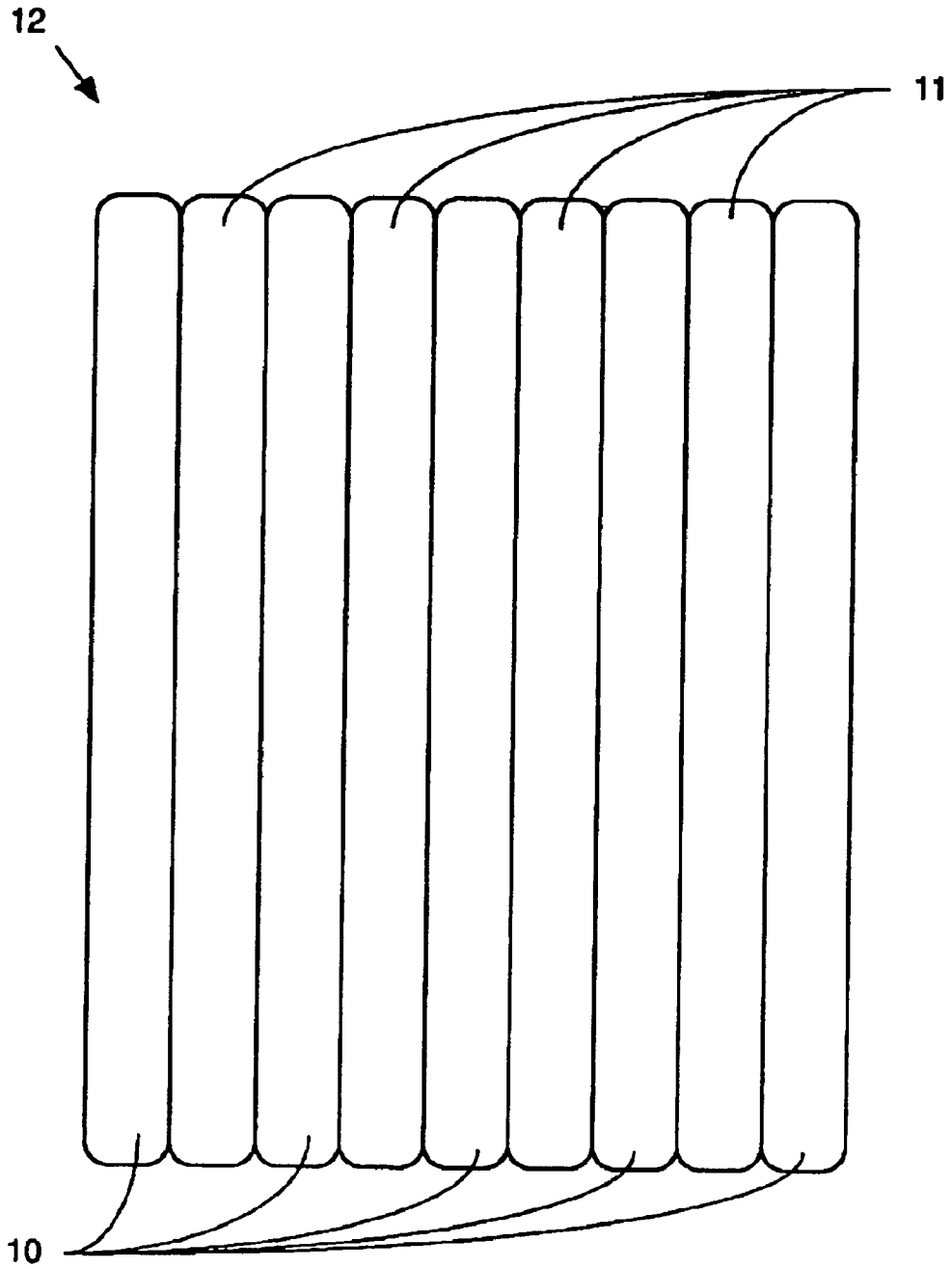
FIG. 4A is a top view of an alternating pressure support surface used in the preferred embodiment of the invention. This view shows a series of compartments (air cells) in which the internal pressure can be dynamically varied. The air cells can run across the bed or lengthwise on the bed.

FIG. 4A is a top view of a preferred embodiment of the alternating pressure support surface 12 used by the invention. In this view, adjoining longitudinal series of cells 10, 11 are arranged in parallel. In each cell, the internal cell pressure can be dynamically varied. However, in the preferred embodiment a first set of cells 10 is interleaved with a second set of cells 11. In the preferred embodiment, each set of cells 10, 11 is controlled by the same pump with associated control circuitry such that one pump, one set of control circuits, and one pressure sensor for each section are required. As noted above, the shape and arrangement of the cells 10, 11 is not critical and may vary. The only requirement is that the inflated, deflated, and cross over pressures are maintained such that pressure on the patient's 1 body by the alternating pressure support surface 12 can be constantly varied to prevent pressure wounds.

Figure 4B:
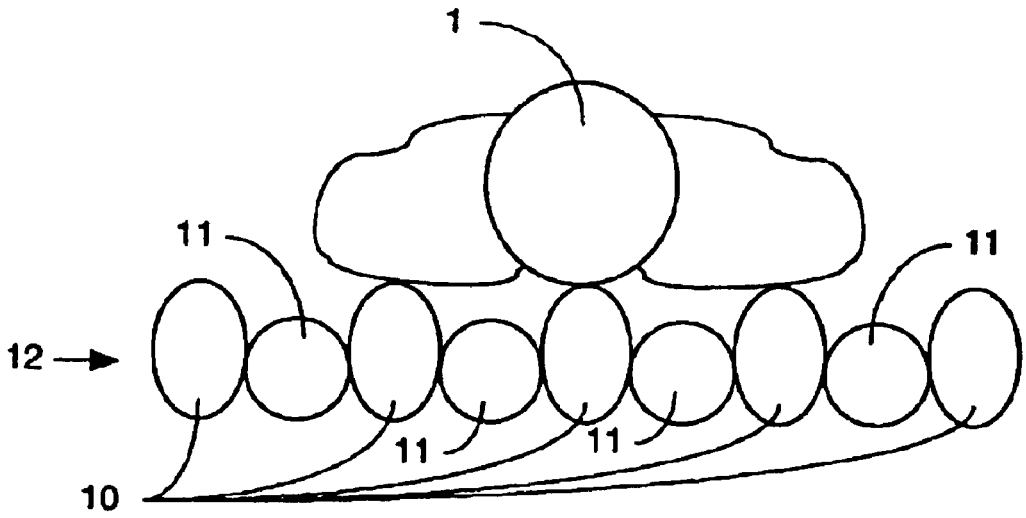
FIG. 4B is an end view of a preferred embodiment of the invention in which a patient is shown lying on the surface of an alternating pressure support surface whose cross over pressure is dynamically controlled. In this figure, the first set of compartments are inflated and a second set compartments are deflated such that there is zero pressure applied against the surface of the patient's body by the second set of compartments.

In FIG. 4B, an end view of the preferred embodiment of the alternating pressure support surface 12 of FIG. 4A. In this figure, cells 10 are in the inflated state and cells 11 are in the deflated state. As shown, the patient's 1 body is in contact only with cells 10, and pressure is only applied to the surface of the patient's 1 body by cells 10. Likewise, cells 11 are deflated such that zero pressure is applied to the surfaces of the patient's 1 body adjacent to cells 11. By eliminating pressure against the surfaces of the patient's 1 body which correspond to cells 11, blood can freely flow in those areas. This reduces the possibility of pressure wounds, and facilitates the healing process for preexisting pressure wounds in those areas.

Figure 4C:
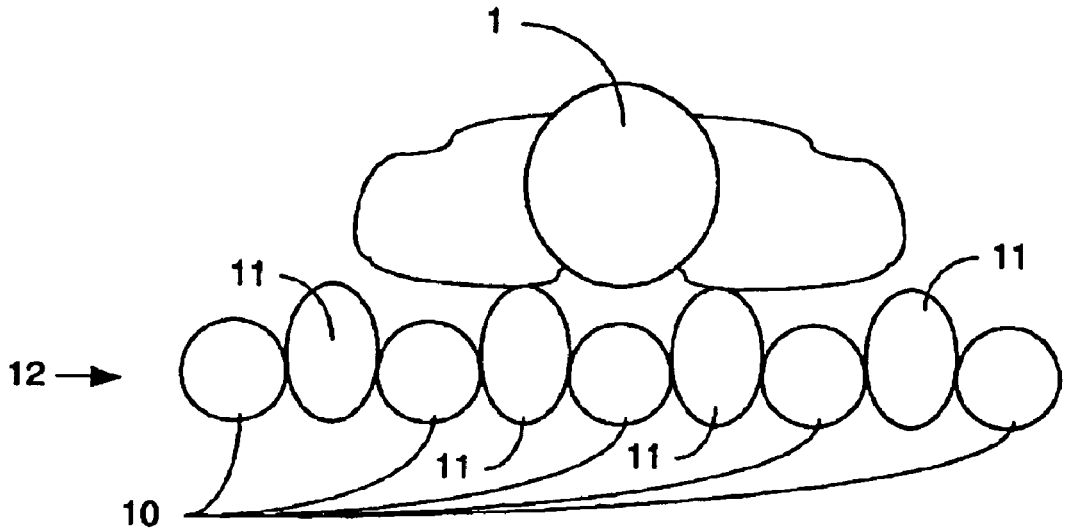
FIG. 4C is an end view of the preferred embodiment of the invention illustrated in FIG. 4B. In this figure, the first set of compartments are deflated and the second set of compartments are inflated such that there is zero pressure applied against the surface of the patient's body by the first set of compartments.

FIG. 4C is an end view of a preferred embodiment of the alternating pressure support surface 12 of FIG. 4A in which cells 10 are in the deflated state and cells 11 are in the inflated state. This is the opposite of the inflation states shown in FIG. 4B. As can be seen in this figure, pressure is now applied to the surface of the patient's 1 body by cells 11 and zero pressure is applied to surface of the patient's 1 body by cells 10. As a result, the points of pressure have been moved and now there is no pressure applied against the patient's 1 body by the cells 10. By ensuring the every area of the patient's 1 body is periodically relieved of pressure, blood flow to all areas of the body is provided that avoids new pressure wounds and helps to heal pre-existing pressure wounds.

Figure 5:
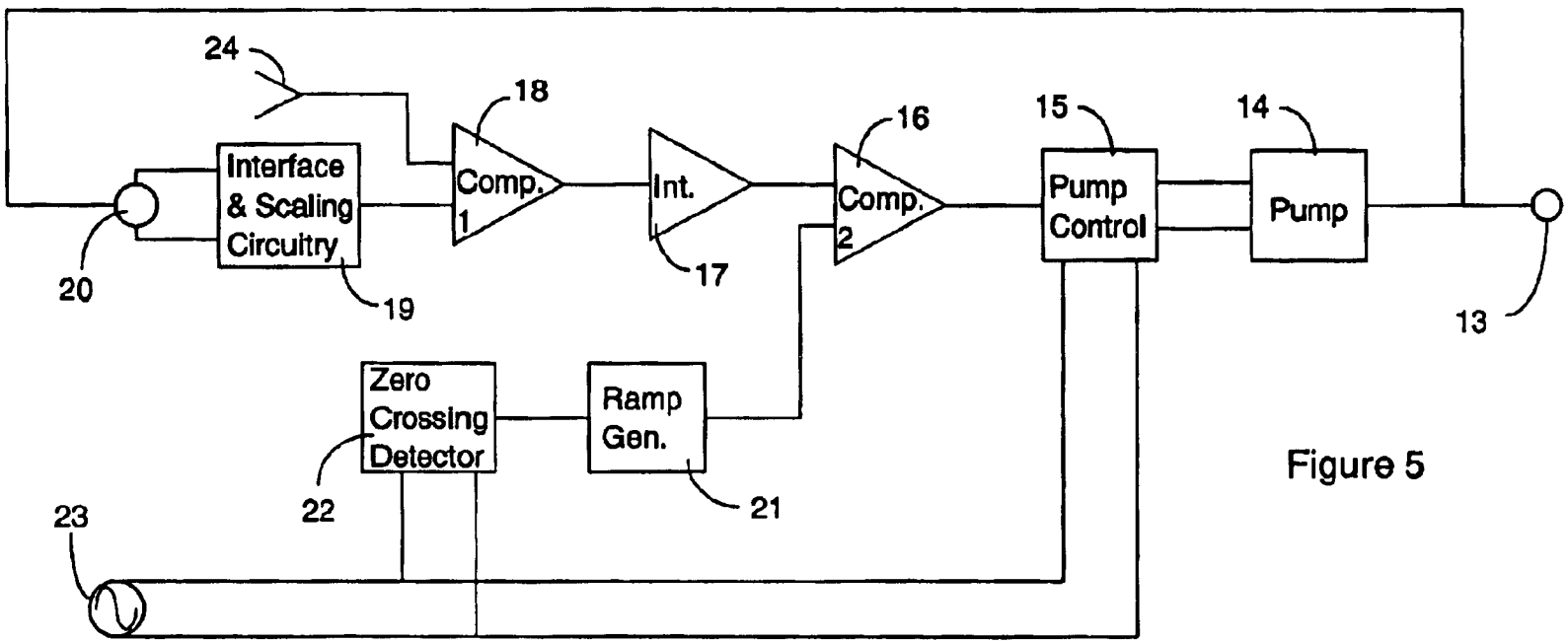
FIG. 5 illustrates a circuit diagram of a preferred embodiment of the invention in which output air pressure provided by the pump is dynamically controlled such that the cross over pressure is not too high or too low.

Dynamic control of air pressure in the deflated state, the inflated state, and the cross over pressure is accomplished in a preferred embodiment as shown in the discussion of FIG. 5.

A first control element is a pressure transducer 20 which measures current output air pressure 13 from the pump 14. The pressure transducer 20 outputs a voltage that is proportional to the pump 14 output pressure 13 detected by the pressure transducer 20. The output of the pressure transducer 20 is then input to the interface and scaling circuit 19 which buffers, amplifies, and adjusts its output based on the output of the pressure transducer 20.

The output of the interface and scaling circuitry 19 represents the pressure 13 that is produced by the pump 14. This output is input to a first comparator 18. The first comparator 18 also has another input which is a DC control voltage 24 that is supplied by an adjustable DC source. Since the output of the first comparator 18 will eventually control pump 14 output pressure 13, the DC control voltage 24 is used to adjust the output of the first comparator 18. By adjusting this voltage, the pump 14 output pressure 13 can be regulated to any selectable level.

The output of the first comparator 18 is input to an integrator 17 that produces an error signal which is based on the difference between actual output pressure 13 and the desired pressure as set by the DC control voltage 24. The error signal is input to a second comparator 16. The second comparator 16 in turn produces an output that controls the pump control 15.

In addition to the input from the integrator 17, the second comparator 16 also has an input from a ramp generator 21. The ramp generator 21 produces a ramp wave which is synchronized to the AC power source 23. The synchronization is controlled by signals output by a zero crossing detector 22 whose input is the AC power source 23. The second comparator 16 uses the inputs provided by the ramp generator 21 and the integrator 17 to provide a variable pulse width signal to the pump control 15.

The pump control 15 receives power from the AC power source 23 and regulates it with the variable pulse width signal input by the second comparator 16 such that the AC power from the AC power source 23 is synchronously chopped to produce an output that drive the pump 14 with only a portion of each sine wave from the AC power source 23.

In the preferred embodiment, a single pump 14 is used to provide air pressure to all of the cells sets. The pressure control system 25 uses solenoid valves to control deflation of specific cells sets. By varying pump output pressure 13 via DC control voltage 24, a single pump 14 can be adjusted to select the desired cross over pressure. The DC control voltage 24 can also be manually adjusted in response to visual display of measured cross over pressure in the cells sets. Of course, a more complicated pressure control system using cells sets that have dedicated pumps and also be used. However, this is less efficient than using the single pump system disclosed herein.

In summary, the pressure control system 25 used by the invention measures the actual pump pressure 13 and compares it to a control voltage which is selectably set by the user. Based on the comparison, the power supplied to the pump 14 is adjusted to control pump output pressure 13. Each set of cells in the alternating pressure support surface 12 may have individual control circuits to allow them to be independently inflated and deflated. The preferred embodiment, however, has one control circuit which cycles the cells sets between inflated and deflated states.

Figure 6:
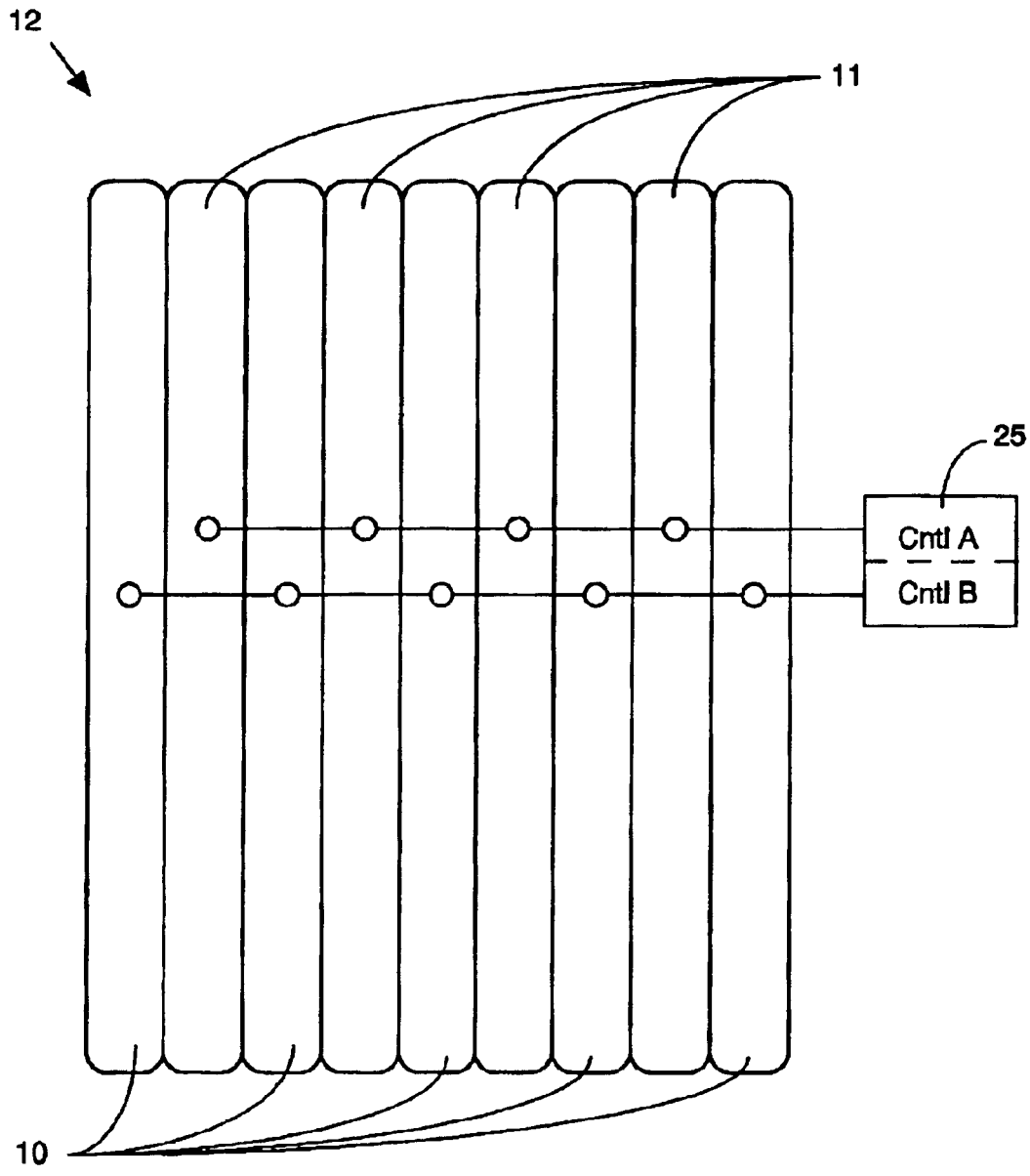
FIG. 6 illustrates an alternating pressure support surface with two sets of cells and a pressure control system with pressure control lines attached to each set of cells.

FIG. 6 illustrates an alternating pressure support surface 12 with two sets of cells 10, 11 and a pressure control system 25 with pressure control lines attached to each set of cells 10, 11. In the preferred embodiment, each pressure control line is controlled by a pressure sensor transducer and one control circuit such as that described above in regard to FIG. 5. The pressure control system 25 also includes a timer to control alternation of the pressure within the cells 10, 11.

Advantages of the invention over prior art devices include the elimination of the need to have caretakers such as nurses rotate the patient, ensuring that rotation will not be inadvertently neglected, ensuring that pressure in the inflated state will be at the proper level, ensuring that pressure in the deflated state will be at the proper level, and ensuring that cross over pressures will be at the proper level.

While the invention has been described with respect to a preferred embodiment thereof, it will be understood by those skilled in the art that various changes in detail may be made therein without departing from the spirit, scope, and teaching of the invention. For example, the material used to construct the alternating pressure support surface may be anything suitable for its purpose, the size, shape, and number of the cell sets can vary, etc. Accordingly, the invention herein disclosed is to be limited only as specified in the following claims.

We claim:

1. An apparatus for controlling pressure in a regulated alternating pressure support surface having a plurality of cells, comprising:

an alternating pressure support surface having at least a first and second set of cells;

a pressure control system for each set of cells, further comprising:

pump means to supply pressure to the sets of cells;

sensing means to measure pressure in the set of cells; and means to adjust the pressure in the set of cells based on the pressure measured by the sensing means;

means to alternate pressure in each set of cells such that when the first set of cells is inflated, the second set of calls is deflated, and when the first set of cells is deflated, the second set of cells is inflated;

means to detect the cross over pressure in the first and second sets of cells; and means to selectably set the cross over pressure in the first and second sets of cells.

2. An apparatus, as in claim 1, further comprising:

a timer to control inflation and deflation of the first and second set of cells such that they inflate and deflate on a periodic basis.

3. An apparatus, as in claim 2, wherein the timer is adjustable.

4. An apparatus, as in claim 2, wherein the first or second set of cells, when deflated, have an internal pressure less than or equal to 3 mmHg.

5. An apparatus, as in claim 1, further comprising:

a DC power source;

means to adjust the output of the DC power source; and comparison means to compare the adjusted output of the DC power source with the pressure measured by the sensing means and produce an output error signal, the comparison means producing a control signal that indicates whether pump output is to be changed.

6. An apparatus, as in claim 5, wherein:

the control signal output by the comparison means is used to control pump output pressure such that cross over pressure is dynamically maintained at a preselected level.

7. An apparatus, as in claim 6, further comprising a timer to control inflation and deflation of the first and second set of cells such that they inflate and deflate on a periodic basis.

8. An apparatus, as in claim 7, wherein the timer is adjustable.

9. An apparatus, as in claim 8, wherein the first or second set of cells, when deflated, have an internal pressure less than or equal to 3 mmHg.

10. A method of avoiding pressure wounds in alternating pressure support surfaces, including the steps of:

providing an alternating support surface that has at least two sets of cells, the sets of cells arranged such that when one set of cells is inflated, and the other set of cells is deflated, the inflated set of cells provides sufficient pressure to support the weight of a patient;

periodically deflating the inflated cells and inflating the deflated cells;

determining the cross over measure by detecting when the pressure in the set of cells that are deflating is equal to the pressure in the set of cells that are inflating; and adjusting air pressure inside the sets of cells such that the air pressure level at the cross over pressure is sufficient to prevent bottoming out.

11. A method, as in claim 10, including the additional steps of:

measuring the output pressure of a pump used to inflate the cells; and comparison means to compare the measured output pressure with a selectable input control value, and adjusting the pump output pressure under control of the selectable input control value.

12. A method of avoiding pressure wounds in alternating pressure support surfaces, including the steps of:

providing an alternating support surface that has at least two sets of cells, the sets of cells arranged such that when one set of cells is inflated, and the other set of cells is deflated, the inflated set of cells provides sufficient pressure to support the weight of a patient;

periodically deflating the inflated cells and inflating the deflated cells; and using a servo-loop circuit to compare the output pump pressure with a selectable DC control voltage, and adjusting pump output levels based on the value of the selectable DC control voltage.

13. A method, as in claim 12, including the additional step of adjusting the output pump pressure to set cross over pressure to a predetermined level.

14. A method, as in claim 13, including the additional step of adjusting the output pump pressure such that when a act of cells is deflated, its internal pressure is less than or equal to 3 mmHg.

15. A method, as in claim 12, including the additional step of adjusting the output pump pressure such that when a set of cells is deflated, its internal pressure is less than or equal to 3 mmHg.

16. A method, as in claim 12, including the additional step of using a timer to control switching of the sets of cells between deflated and inflated states after a predetermined time interval.

17. An apparatus for controlling pressure in a regulated alternating pressure support surface having a plurality of cells, comprising:

an alternating pressure support surface having at least a first and second set of cells;

pump means to supply pressure to the sets of cells;

sensing means to measure pressure in the set of cells;

means to adjust the pressure in the set of cells based on the pressure measured by the sensing means;

means to alternate pressure in each set of cells such that when the first set of cells is inflated, the second set of cells as deflated, and when the first set of cells is deflated, the second set of cells is inflated;

determining the cross over pressure by detecting when the pressure in the set of cells that are deflating is equal to the pressure in the set of cells that are inflating; and adjusting air pressure inside the sets of cells such that the air pressure level at the cross over pressure is sufficient to prevent bottoming out.

18. An apparatus for controlling pressure in a regulated alternating pressure support surface having a plurality of cells, comprising:

an alternating pressure support surface having at least a first and second set of cells;

pump means to supply pressure to the sets of cells;

sensing means to measure pressure in the set of cells;

means to adjust the pressure in the set of cells based on the pressure measured by the sensing means;

means to alternate pressure in each set of cells such that when the first set of cells is inflated, the second set of cells is deflated, and when the first set of cells is deflated, the second set of cells is inflated;

means to detect the cross over pressure in the sets of cells; and means to selectably control pump output pressure, based on the detected cross over pressure, to adjust the cross over pressure in the sets of cells to a preselected level.

19. An apparatus, as in claim 18, further comprising:

means to visually display the detected cross over pressure; and means to manually control pump output pressure, based on the visual display of the detected cross over pressure, such that the cross over pressure in the sets of cells is set to a selectable level.

20. An apparatus, as in claim 19, wherein the sets of cells, when deflated, have an internal pressure less than or equal to 3 mmHg.

* * * * *